US010208473B1

(12) United States Patent
Meyer

(10) Patent No.: US 10,208,473 B1
(45) Date of Patent: Feb. 19, 2019

(54) PORTABLE SHED SYSTEM

(71) Applicant: Scott Meyer, Blanding, UT (US)

(72) Inventor: Scott Meyer, Blanding, UT (US)

( * ) Notice: Subject to any disclaimer, the term of this patent is extended or adjusted under 35 U.S.C. 154(b) by 0 days.

(21) Appl. No.: 15/709,636

(22) Filed: Sep. 20, 2017

(51) Int. Cl.
*E04B 1/343* (2006.01)
*E04H 1/12* (2006.01)
*E04H 6/02* (2006.01)
*E06B 5/02* (2006.01)

(52) U.S. Cl.
CPC ..... *E04B 1/34347* (2013.01); *E04H 1/1205* (2013.01); *E04H 6/02* (2013.01); *E06B 5/02* (2013.01)

(58) Field of Classification Search
CPC ..... E04B 1/34347; E04H 6/02; E04H 1/1205; E06B 5/02
USPC ..... 52/143, 79.5, 270, 588.1, 591.1, 64, 69, 52/79.1; 206/335
See application file for complete search history.

(56) References Cited

U.S. PATENT DOCUMENTS 2,293,569 A * 8/1942 Sonion ..... E04B 1/3445 52/127.2
2,793,401 A * 5/1957 Paschke ..... E04H 1/12 52/264
3,296,756 A * 1/1967 Wade ..... E04B 1/34315 52/127.9
3,463,174 A * 8/1969 Heller ..... B60J 11/00 135/119
3,512,316 A * 5/1970 Parr ..... E04B 1/34321 52/262
3,667,172 A * 6/1972 Erickson ..... E04H 6/02 52/143
4,016,686 A * 4/1977 Hartger ..... E04H 6/005 206/335
4,242,846 A * 1/1981 Hurd ..... E04H 6/04 52/64
4,467,572 A * 8/1984 Somers ..... A63H 33/008 16/225
4,570,392 A * 2/1986 Oltman ..... E04H 1/1205 52/64
4,800,701 A * 1/1989 Dunsworth ..... E04H 6/005 52/143
4,842,458 A * 6/1989 Carpenter ..... B60P 7/083 242/379.2
4,876,832 A * 10/1989 Wasserman ..... A01D 34/001 52/169.9

(Continued)

FOREIGN PATENT DOCUMENTS

WO WO2007029026 3/2007

*Primary Examiner* — Joshua K Ihezie

(57) ABSTRACT

A portable shed system for securing motorized equipment therein includes a top wall and a perimeter wall that is attached to and extends downwardly therefrom defining a receiving space. The perimeter wall includes a back wall, a front wall and two lateral walls. The front wall comprises a door opening with a front door hingedly coupled thereon and positionable in a closed position covering or an open position exposing the receiving space.

A plurality of eyelets is attached to the perimeter wall. A plurality of stakes, each of the eyelets has one of the stakes extending therethrough and into a ground surface securing the housing thereon.

A plurality of couplers is positioned inside said housing. A plurality of tethers each is attached to one of the couplers on one end and attached to a motorized device positioned within the receiving space on the other end.

11 Claims, 4 Drawing Sheets

(56) References Cited

U.S. PATENT DOCUMENTS 4,944,321 A * 7/1990 Moyet-Ortiz ..... B60J 11/00 135/148
5,184,436 A * 2/1993 Sadler ..... E04B 1/34321 446/478
5,265,385 A * 11/1993 Smith ..... B65D 85/68 52/143
5,354,035 A * 10/1994 Helgren ..... B62H 3/12 211/18
5,529,448 A * 6/1996 Kosma ..... B60P 3/079 248/499
5,657,583 A 8/1997 Tennant
6,012,253 A * 1/2000 Burns ..... B65D 11/1873 220/4.34
6,418,672 B1 * 7/2002 Hampel ..... E04H 1/1216 4/460
6,439,645 B1 * 8/2002 Pedersen ..... E04H 15/06 135/88.05
6,786,010 B1 * 9/2004 McNabb ..... E04H 6/005 135/116
6,802,327 B2 * 10/2004 Koss ..... E04H 15/06 135/137
D547,880 S 7/2007 Ashby et al.
7,966,774 B2 * 6/2011 Kea, Jr. ..... B62H 3/00 52/66
8,132,372 B2 3/2012 Mower et al.
8,578,661 B1 * 11/2013 Braley ..... A01M 31/02 52/71
8,678,726 B1 * 3/2014 Stubbs ..... B60P 3/079 410/23
2004/0232021 A1 * 11/2004 Linton ..... B65D 85/68 206/335
2005/0108955 A1 5/2005 Howe et al.
2005/0210761 A1 * 9/2005 Mower ..... E04B 1/12 52/64
2007/0094947 A1 * 5/2007 Greenfeld ..... E04H 6/04 52/79.1
2007/0189873 A1 * 8/2007 Breeden ..... B60P 7/083 410/100
2008/0210284 A1 9/2008 Dubois
2009/0107056 A1 * 4/2009 Kirilichin ..... E04H 6/005 52/79.1
2011/0162292 A1 * 7/2011 Higley ..... E04B 1/12 52/79.1
2011/0185644 A1 * 8/2011 Hutter ..... E04H 1/12 52/79.1
2012/0291371 A1 11/2012 Brown
2014/0047781 A1 * 2/2014 Miller ..... A01M 31/025 52/79.5

* cited by examiner

PORTABLE SHED SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM.

Not Applicable

STATEMENT REGARDING PRIOR DISCLOSURES BY THE INVENTOR OR JOINT INVENTOR

Not Applicable

BACKGROUND OF THE INVENTION

1. Field of the Invention.
2. Description of Related Art including information disclosed under 37 CFR 1.97 and 1.98.

The disclosure and prior art relates to portable shed devices and more particularly pertains to a new portable shed device configured for securing motorized equipment therein.

BRIEF SUMMARY OF THE INVENTION

An embodiment of the disclosure meets the needs presented above by generally comprising a housing that includes a top wall and a perimeter wall that is attached to and extends downwardly from the top wall. The perimeter wall includes a back wall, a front wall, a first lateral wall and a second lateral wall. The front wall has a door opening that extends therethrough. A receiving space is defined beneath the top wall and is accessible through the door opening. The housing has an inner surface and an outer surface.

A front door is hingedly coupled to the front wall and is positionable in a closed position such that the door opening is closed or in an open position allowing entry into the receiving space. The front door is positioned opposite of the back wall.

A plurality of eyelets is attached to the perimeter wall adjacent to a lower edge thereof. A plurality of stakes, each of the eyelets has one of the stakes extending therethrough and into a ground surface to secure the housing to the ground surface.

A plurality of couplers is positioned on the inner surface. A plurality of tethers, each of the tethers has a first end and a second end. Each of the couplers has one of the first ends removably attached thereto. The second ends are configured to be attached to a motorized device positioned within the receiving space.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
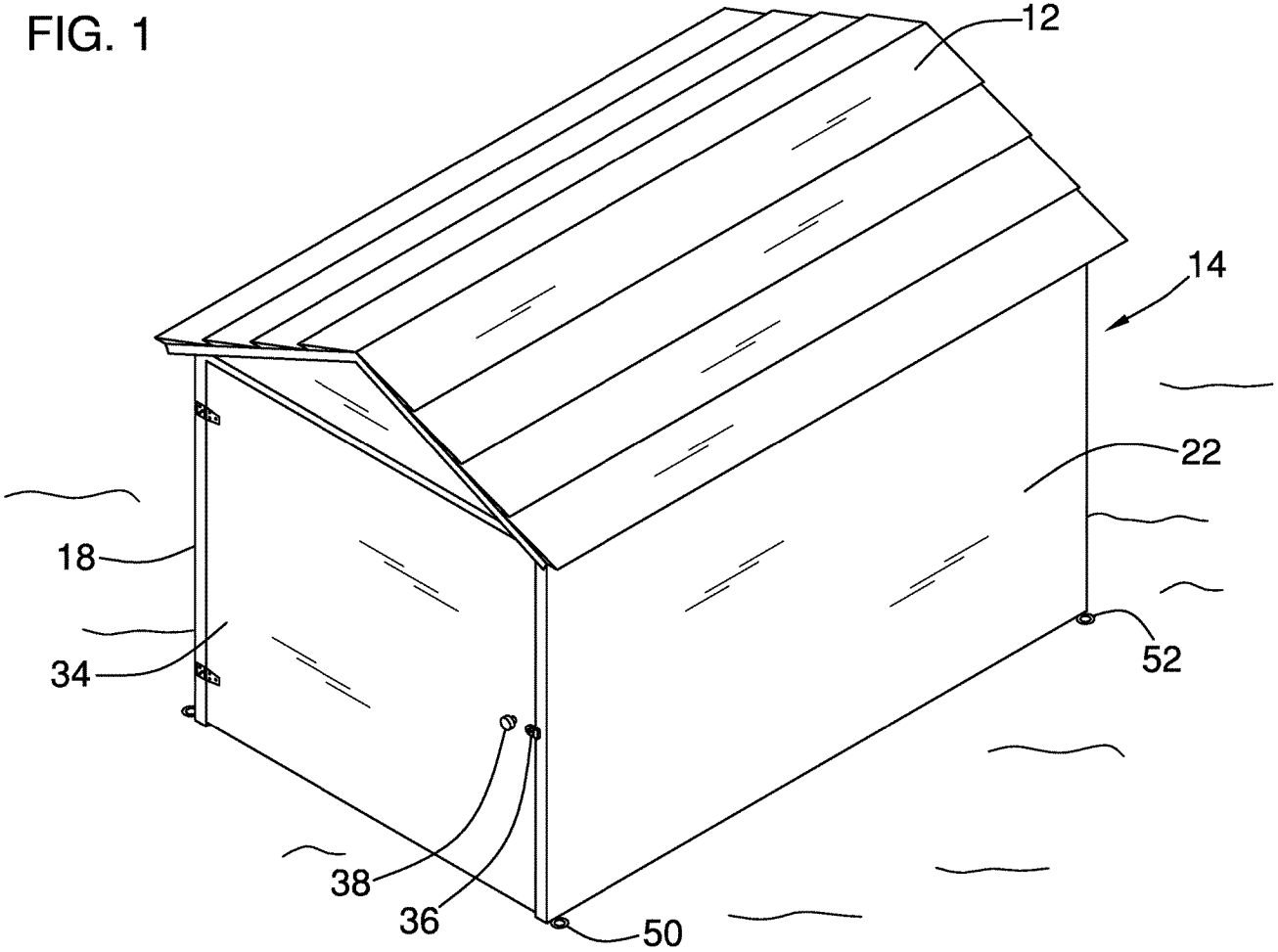
FIG. 1 is a top perspective view of a portable shed system according to an embodiment of the disclosure.
Figure 3:
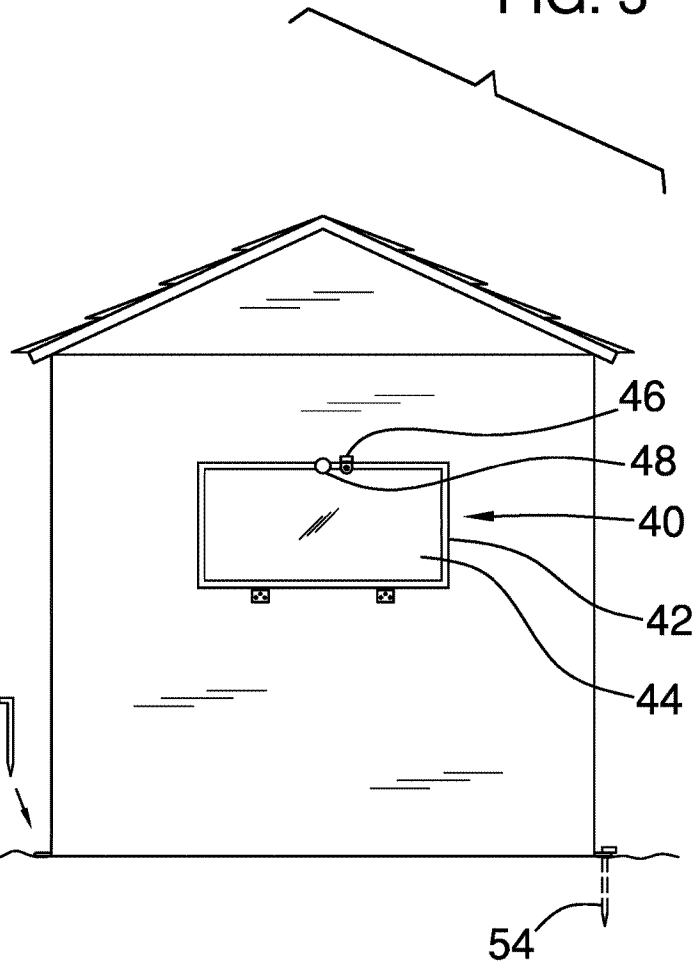
FIG. 3 is a back view of an embodiment of the disclosure.
Figure 2:
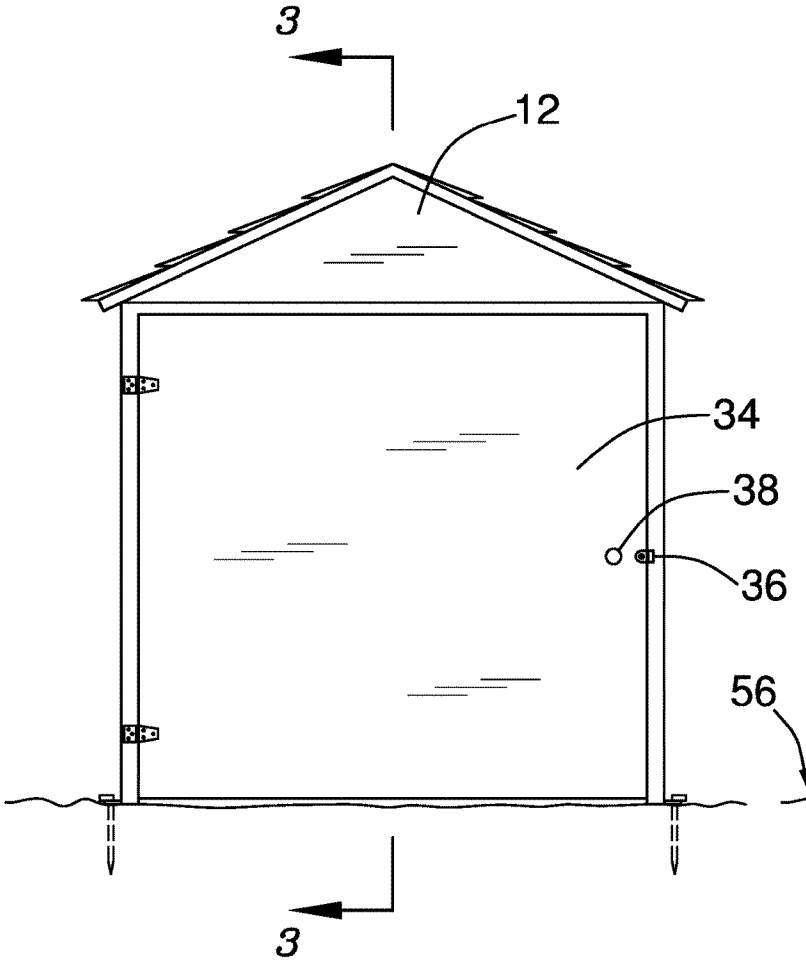
FIG. 2 is a front view of an embodiment of the disclosure.
Figure 4:
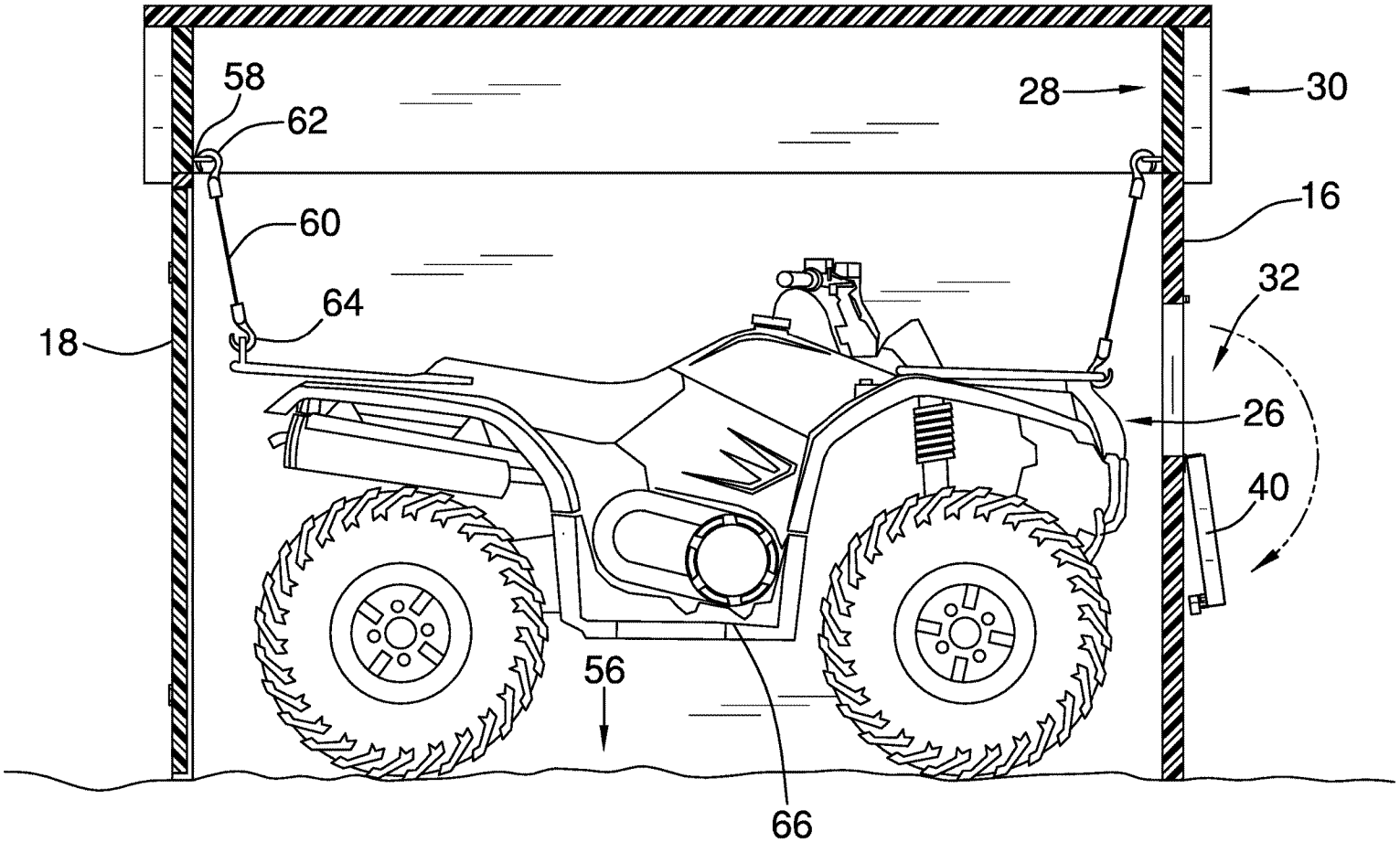
FIG. 4 is a cross-sectional view of an embodiment of the disclosure taken along the line 3-3 of FIG. 2.
Figure 5:
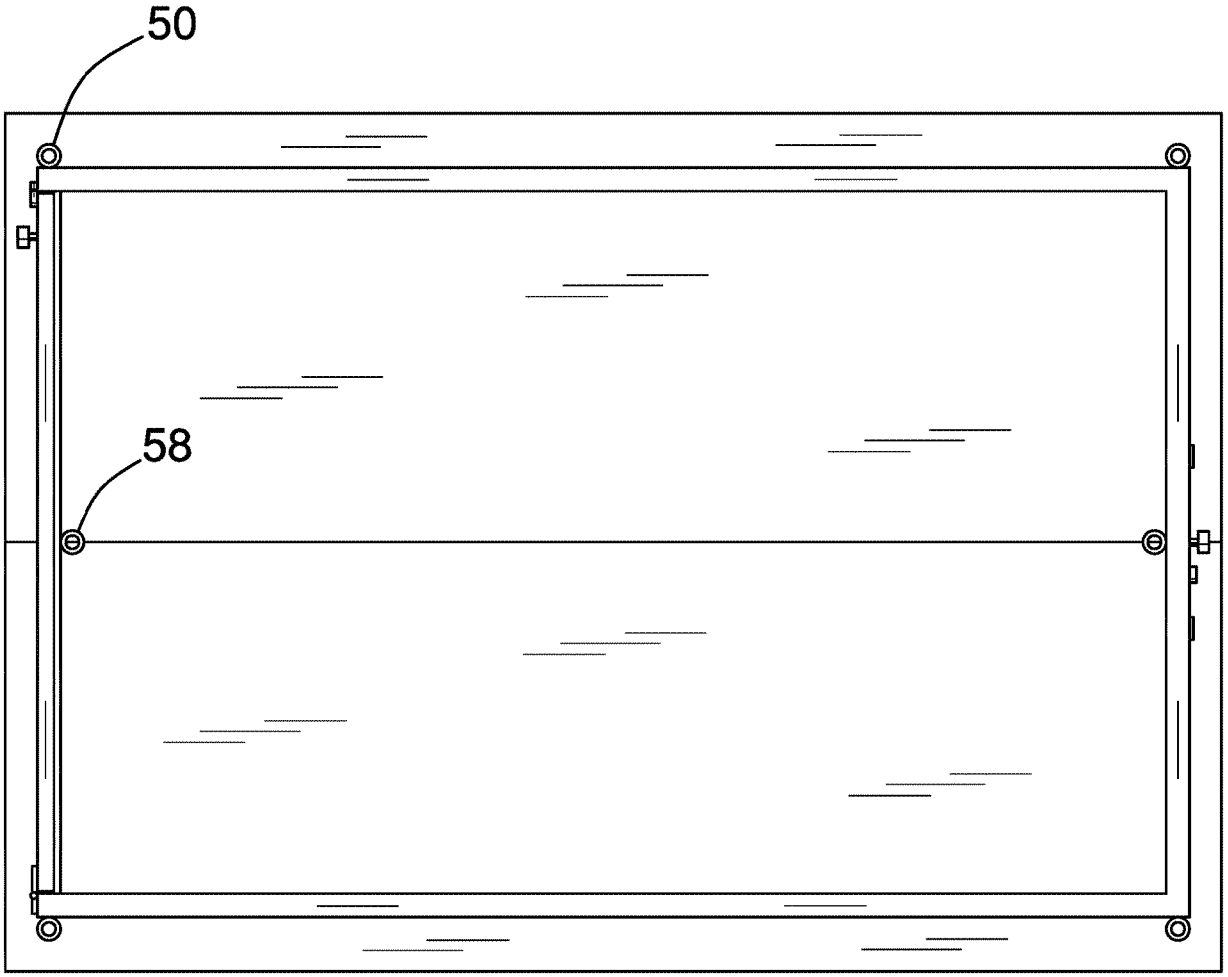
FIG. 5 is a bottom view of an embodiment of the disclosure.

With reference now to the drawings, and in particular to FIGS. 1 through 6 thereof, a new portable shed assembly embodying the principles and concepts of an embodiment of the disclosure and generally designated by the reference numeral 10 will be described.

As best illustrated in FIGS. 1 through 6, the portable shed system 10 generally comprises housing that includes a top wall 12 and a perimeter wall 14 that is attached to and extends downwardly from the top wall 12. The perimeter wall 14 includes a back wall 16, a front wall 18, a first lateral wall 20 and a second lateral wall 22. The front wall 18 has a door opening 24 that extends therethrough. A receiving space 26 is defined beneath the top wall 12 and is accessible through the door opening 24. The perimeter wall 14 has an inner surface 28 and an outer surface 30. The top wall 12 comprises a peaked roof. The back wall 16 has an opening 32 therein for viewing the receiving space 26. The housing has a length that is between 65.0 inches and 95.0 inches and a width that is between 40.0 inches and 65.0 inches. The perimeter wall 14 has a height between 40.0 inches and 60.0 inches.

A front door 34 is hingedly coupled to the front wall 18 and is positioned in a closed position that closes the door opening 24 or in an open position that allows entry into the receiving space 26. The front door 34 is positioned opposite of the back wall 16. A lock 36 is mounted on the front door 34 and releasably engages the perimeter wall 14 to retain the front door 34 in the closed position. A handle 38 is attached to the front door 34.

A window 40 comprises a window frame 42 and transparent pane 44 that is hingedly coupled to the back wall 16 and removably covers the opening 32. A securing member 46 is mounted on the window 40 and releasably secures the window 40 in a closed position that covers the opening 32. A knob 48 is mounted on the window to facilitate a user's grip of the window 40.

A plurality of eyelets 50 is attached to the perimeter wall 14 adjacent to a lower edge thereof. The housing includes four corners and each of the corners 52 has one of the eyelets 50 positioned adjacent thereto. A plurality of stakes 54, each of the eyelets 50 has one of the stakes 54 extended therethrough and into a ground surface 56 to secure the housing to the ground surface 56.

A plurality of couplers 58 is positioned on the inner surface 28. Each of the front 18 and back walls 16 has at least one of the couplers 58 mounted thereto. The couplers 58 are positioned adjacent to the top wall 12. A plurality of tethers 60, each of the tethers 60 has a first end 62 and a second end 64. Each of the tethers 60 is resiliently stretchable and may comprise of an elastic cord but should be understood as any material that is resiliently stretchable. Each of the first 62 and second ends 64 comprises a hook. Each of the couplers 60 has one of the first ends 62 removably attached thereto. The second ends 64 are attachable to a motorized device 66 positioned within the receiving space 26. The motorized device 66 may be an all-terrain vehicle, a lawn mower or any other motorized device 66 that fits in the receiving space 26.

In use, the assembly 10 is positioned on a ground surface 56. Each of the eyelets 50 has one of the stakes 54 extended therethrough and into the ground surface 56 securing the assembly 10 to the ground surface 56. The front door 34 is opened and a motorized device 66 may be positioned with in. The user may removably attach the motorize device 66 to a plurality of tethers 60. The tethers 60 are they secured to the couplers 58 such that the motorized device 66 is removably secured to the assembly 10. The window 40 may be opened and allow the user to secure the tethers 60 to the couplers 58 mounted to the back wall 16. The front door 34 is then shut and locked into the closed position securing the motorized device 66 inside said assembly 10.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A portable shed assembly configured to be releasably secured to a ground surface for securing motorized equipment therein, said assembly comprising:

a housing including a top wall and a perimeter wall being attached to and extending downwardly from said top wall, said perimeter wall including a back wall, a front wall, a first lateral wall and a second lateral wall, said front wall having a door opening extending therethrough, a receiving space being defined beneath said top wall and being accessible through said door opening, said housing having an inner surface and an outer surface;

a front door being hingedly coupled to said front wall and being positioned in a closed position closing said door opening or in an open position allowing entry into said receiving space, said front door being positioned opposite of said back wall;

a plurality of eyelets being attached to said perimeter wall adjacent to a lower edge thereof;

a plurality of stakes, each of said eyelets having one of said stakes extending therethrough and into a ground surface to secure said housing to the ground surface;

a plurality of couplers being positioned on said inner surface, said couplers being positioned adjacent to said top wall wherein each of said couplers is configured to be positioned vertically spaced above a motorized device positioned within said receiving space; and a plurality of tethers, each of said tethers having a first end and a second end, each of said couplers has one of said first ends removably attached thereto, said second ends being configured to be attached to the motorized device positioned within said receiving space.

2. The portable shed assembly according to claim 1, wherein said top wall comprises a peaked roof.

3. The portable shed assembly according to claim 1, wherein said back wall has an opening therein for viewing said receiving space.

4. The portable shed assembly according to claim 1, wherein said housing has a length being between 65.0 inches and 95.0 inches and a width being between 40.0 inches and 65.0 inches, said perimeter wall having a height between 40.0 inches and 60.0 inches.

5. The portable shed assembly according to claim 1, further including a lock being mounted on said front door and releasably engaging said perimeter wall to retain said front door in said closed position.

6. The portable shed assembly according to claim 1, further including a handle being attached to said front door.

7. The portable shed assembly according to claim 1, further including a window comprising a window frame and transparent pane being hingedly coupled to said back wall and removably covering said opening.

8. The portable shed assembly according to claim 7, further including a securing member being mounted on said window and releasably securing said window in a closed position covering said opening.

9. The portable shed assembly according to claim 7, further including a knob being mounted on said window to facilitate gripping of said window.

10. The portable shed assembly according to claim 1, wherein each of said tethers is resiliently stretchable.

11. A portable shed assembly configured to be releasably secured to a ground surface for securing motorized equipment therein, said assembly comprising:

a housing including a top wall and a perimeter wall being attached to and extending downwardly from said top wall, said perimeter wall including a back wall, a front wall, a first lateral wall and a second lateral wall, said front wall having a door opening extending therethrough, a receiving space being defined beneath said top wall and being accessible through said door opening, said housing having an inner surface and an outer surface, said top wall comprising a peaked roof, said back wall having an opening therein for viewing said receiving space, said housing having a length being between 65.0 inches and 95.0 inches and a width being between 40.0 inches and 65.0 inches, said perimeter wall having a height between 40.0 inches and 60.0 inches;

a front door being hingedly coupled to said front wall and being positioned in a closed position closing said door opening or in an open position allowing entry into said receiving space, said front door being positioned opposite of said back wall;

a lock being mounted on said front door and releasably engaging said perimeter wall to retain said front door in said closed position;

a handle being attached to said front door;

a window comprising a window frame and transparent pane being hingedly coupled to said back wall and removably covering said opening;

a securing member being mounted on said window and releasably securing said window in a closed position covering said opening;

a knob being mounted on said window to facilitate gripping of said window;

a plurality of eyelets being attached to said perimeter wall adjacent to a lower edge thereof, said housing including four corners and each of said corners has one of said eyelets positioned adjacent thereto;

a plurality of stakes, each of said eyelets having one of said stakes extending therethrough and into a ground surface to secure said housing to the ground surface;

a plurality of couplers being positioned on said inner surface, each of said front and back walls having at least one of said couplers mounted thereto, said couplers being positioned adjacent to said top wall wherein each of said couplers is configured to be positioned vertically spaced above a motorized device positioned within said receiving space; and a plurality of tethers, each of said tethers having a first end and a second end, each of said couplers has one of said first ends removably attached thereto, each of said first and second ends comprising a hook, said second ends being configured to be attached to the motorized device positioned within said receiving space, each of said tethers being resiliently stretchable.

* * * * *